US005752615A

United States Patent [19]

Hofmann et al.

[11] Patent Number: 5,752,615

[45] **Date of Patent: *May 19, 1998**

[54] SAFETY CONTAINER

[75] Inventors: Richard W. Hofmann, Chicago; Alex J. Kutaj, Vernon Hills, both of Ill.

[73] Assignee: Magenta Corporation, Chicago, Ill.

[ * ] Notice: The term of this patent shall not extend beyond the expiration date of Pat. No. 5,740,938.

[21] Appl. No.: 797,577

[22] Filed: Feb. 7, 1997

Related U.S. Application Data

[63] Continuation of Ser. No. 404,034, Mar. 14, 1995, abandoned.

[51] Int. Cl.[6] ..... B65D 45/16

[52] U.S. Cl. ..... 220/324; 220/339; 220/4.23

[58] Field of Search ..... 220/339, 338, 220/337, 315, 324, 326, 4.22, 4.23, 4.24, 281, 334; 215/237, 216; 206/531

[56] References Cited

U.S. PATENT DOCUMENTS

| | | | |
|---|---|---|---|
| 3,258,150 | 6/1966 | Braginetz | 220/315 X |
| 3,891,070 | 6/1975 | Montanari . | |
| 3,913,774 | 10/1975 | Vajtay | 220/315 X |
| 4,212,415 | 7/1980 | Neely | 220/324 X |
| 4,293,266 | 10/1981 | St. Lawrence et al. . | |
| 4,733,794 | 3/1988 | Kent | 220/339 |
| 4,746,008 | 5/1988 | Heverly et al. | 220/338 X |
| 4,915,251 | 4/1990 | Payne | 220/4.23 |
| 5,295,602 | 3/1994 | Swanson . | |
| 5,346,069 | 9/1994 | Intini | 215/216 X |
| 5,394,902 | 3/1995 | Shibao . | |

FOREIGN PATENT DOCUMENTS

| | | |
|---|---|---|
| 630298 | 7/1963 | Belgium . |
| 0356322 | 2/1990 | European Pat. Off. . |
| 0368693 | 5/1990 | European Pat. Off. . |

*Primary Examiner*—Allen N. Shoap
*Assistant Examiner*—Nathan Newhouse
*Attorney, Agent, or Firm*—Laff, Whitesel, Conte & Saret, Ltd.

[57] ABSTRACT

A container including a base and an associated cover which form an enclosure for blister packs, pills, medication or other small articles. The container includes at least three latches located around the perimeter of the container to hold it closed. The latches can only be disengaged by applying pressure to all the latches simultaneously. In addition, the latches are spaced from each other so that two hands are required to simultaneously release all of the latches. Openings are advantageously placed near the latches to allow the user to exert inward pressure on the walls of the container, which pressure acts to disengage the latches.

6 Claims, 5 Drawing Sheets

FIG. 6
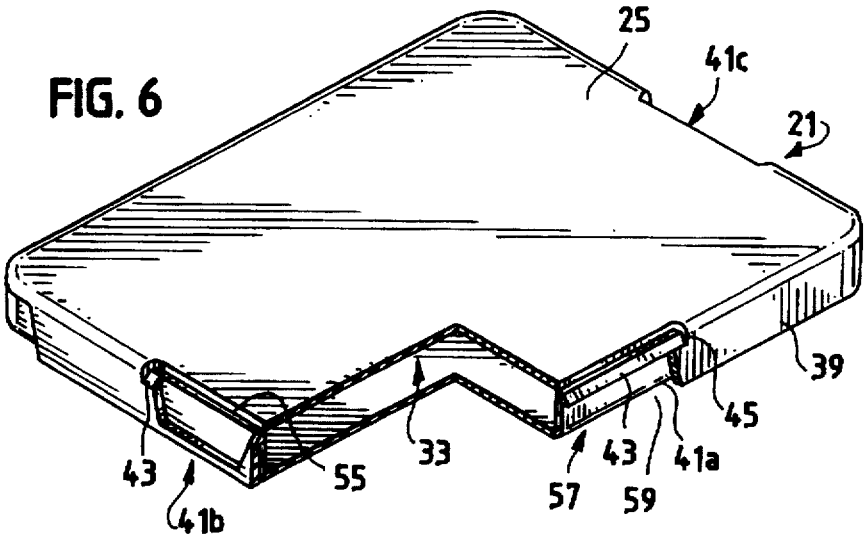
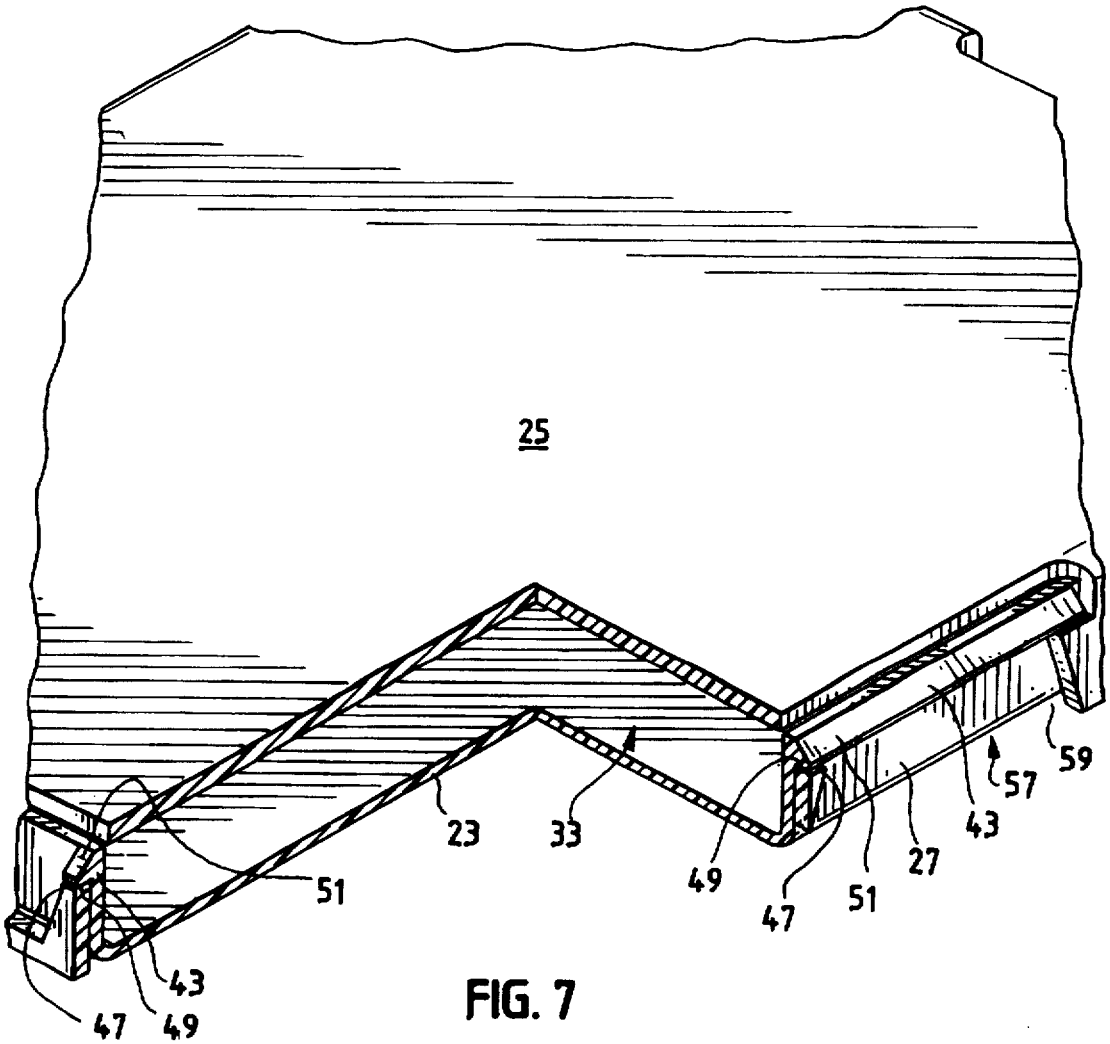
FIG. 7

SAFETY CONTAINER

This is a continuation of my application 08/404,034 filed Mar. 14, 1995, now abandoned.

FIELD

This invention relates to containers used for storing articles, and more particularly, to a safety container for storing items, such as blister packaged medicines.

BACKGROUND

Blister-packaged medicines are generally arranged on "cards", and the cards are enclosed and packaged in a box. The boxes usually are stiff paper or cardboard and hence have the disadvantage that they can be readily tampered with or opened by inquisitive children. Once a child gains access to the inside of the cardboard box or other easily opened container holding the blister-packaged medicines, it is usually straightforward to open the blister packages and potentially gain access to multiple dosages.

The widely used packaging for blister-packaged medicines have deficiencies. For example, known containers for medicine include an area in which the medicine or tablets can be stored, and a cover which overlies the area. The cover may be equipped so that it latches to, or otherwise releasably engages, the edge of the storage container for the pills. In this way, an individual can open the container in order to access some or all of the contents, and then reclose the container by re-engaging the cover over the storage area. Such containers have found application not only for individuals who may wish to transport predetermined dosages of a variety of pills, tablets and/or capsules in the container, but also for manufacturers of medications or other pharmaceuticals. The SUCRETS container is an example of such. However, such containers are ill-suited to serving as safety containers for medication such as blister-packaged medicines. In addition, such pillboxes suffer from various other drawbacks and disadvantages. For example, covers of these containers are often latched closed at only one point or along one side. As such, when the container is jostled within a purse or pocket, or otherwise handled, the latch may be inadvertently activated, potentially spilling the contents of the container.

In addition, medication contained in such container generally cannot be kept from inquisitive children and their prying fingers. The cover of the container generally can be readily released by a child merely by the child's pulling up on the cover or pulling at any latch which might connect the cover to the container. Allowing a child access to the contents of containers is obviously undesirable in all cases, but when the containers contain multiple dosages of pills and the like, the risk of harm to inquisitive children is further magnified.

Because tablet containers are generally not child-resistant, individuals who wish to use such containers around children must either take extra care to secrete the pillboxes away from children's reach or else constantly keep the container on his or her person. Because of this inconvenience, as well as the risk of multiple dosages falling into children's hands, individuals with children often elect to forego the convenience of medicine boxes entirely.

Companies that manufacture and distribute medication in blister packages or otherwise are even less inclined to use pillboxes because the risk of child access would be multiplied by the volume of any pillboxes distributed. Accordingly, most pharmaceutical manufacturers have elected not to distribute medication or blister packaged medicines commercially in pillboxes.

In order to keep medication, such as tablets, capsules and pills, from children's reach, medication has been generally stored or distributed in bottles with child-resistant caps. Such bottles generally cannot effectively store blister-packaged medicines and, when used with non-packaged medicines, suffer from additional drawbacks and disadvantages. For example, the bottle-like shape of such containers is usually inconvenient to carry.

In addition to the above outlined disadvantages of current child-resistant closure, most all of these closures require rotation of the cap relative to the underlying container. This motion is often not readily performed by ailing individuals.

SUMMARY

Accordingly, an object of this invention is to provide a new and improved container for medication which is both child-resistant and readily operable by the intended user.

According to the present invention, the foregoing and other objects and advantages are attained by a safety container which has a base and a corresponding cover. The base and the cover meet at their respective edges to enclose a space for storing the medication. At least three latches or locks are spaced along the perimeter of the container so that two hands are needed to open all three of the locks or latches simultaneously in order to open the safety container.

Each of the locks are releasable by a separate finger pressure at a single point.

According to another aspect of the invention, the safety container is shaped to have a front and opposing sides, and the latches are located on the front and on each of the sides. The distance between the side latches can exceed 4 inches according to still another aspect of the invention, which will inhibit a hand with fingers spanning less than 4 inches, such as a child's hand, from the required simultaneous releasing or opening of the latches on the sides with one hand.

In a further aspect of the invention, the latches comprise nubs located on the wall of the base and corresponding slots located on the cover. The wall is displaceable in relation to the cover to disengage the nubs from the slots. The slots may be configured as notches which extend through the surface and have ledge portions located near the edge of the cover. The nubs may be formed into prongs having surfaces which engage the ledge portions to secure the cover to the base.

In accordance with yet another aspect of the invention, the cover includes depending portions which overlie the sides of the base when the safety container is closed. The sides of the base can be accessed through openings in the depending portions. Inward finger pressure on each of the latches through the respective openings displaces the side of the base inwardly and disengages the latches to open the safety container.

Still other objects, advantages, and novelties of the present invention will become apparent in the detailed description that follows, in which the preferred embodiment of the invention is shown by way of illustration of the best mode contemplated for carrying out the invention, and by reference to the attached drawings in which:

BRIEF DESCRIPTION OF THE DRAWINGS

FIG. 6 is a perspective view of the safety container of FIG. 1 with a corner section cut away;

FIG. 7 is an enlarged perspective view of the cut away portion of the safety container of FIG. 6;

DESCRIPTION

Figure 1:
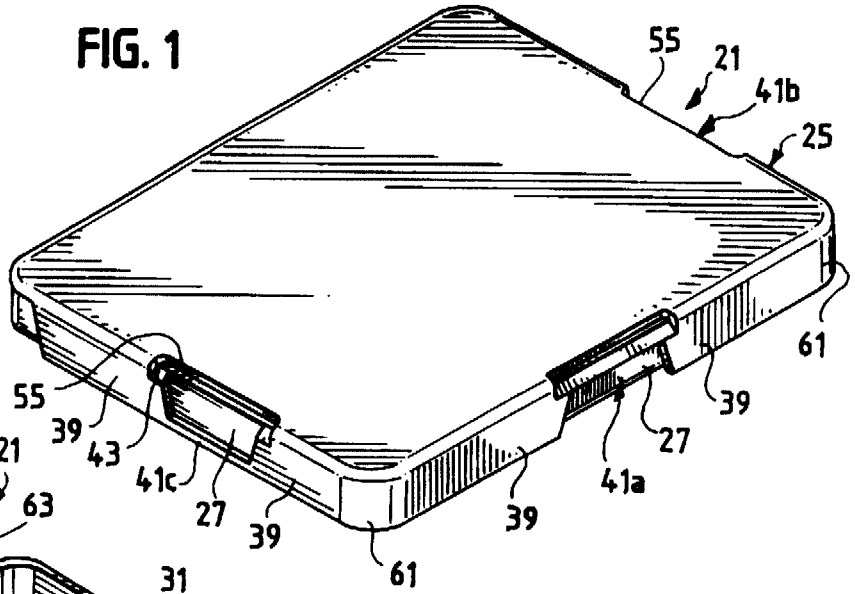
FIG. 1 is a perspective view of a safety container in the closed position embodying the invention.

Referring to FIGS. 1–5, a safety container or pillbox 21 includes a base 23 and a cover 25 positionable over the base 23 to close the safety container 21. In this embodiment, the base 23 has a rectangular bottom portion 29 with a surrounding wall 27 extending upwardly from the bottom 29. The wall has an upper edge 31, and the bottom portion 29 and the wall 27 together define an enclosure, or open container, 33 into which blister-packaged medicines, pills, or other medication can be placed. The wall 27 is formed of a resilient material, thereby allowing portions of the wall to be laterally displaced when a lateral force is applied to it. Portions of the wall 27 form a front wall 35, a back wall 36, and opposite side walls 37 extending between the front wall 35 and the back wall 36 to form the container 33.

The cover 25 is attached to the back wall 36 of the base 23 (FIG. 2) by a living or a piano type hinge 63. The piano hinge 63 in this embodiment is integral with the base 23 and the cover 25, although a separate hinge may also be provided. When the safety container 21 is closed as shown in FIG. 1, the edge of the cover 25 opposes the upper edge 31 of the peripheral wall 27 to cover the container 33.

The cover 25 includes depending side and front portions 39 which extend generally perpendicularly from the top of the cover 25. The depending portions 39 extend along the edge of the top of the cover 25 and include openings 53 therein. The openings are of sufficient size to allow fingertips and/or thumb tip to pass through them. When the safety container 21 is closed, the depending portions 39 lie adjacent to the wall 27 of the base 23 and outside of the enclosure 33 to form outside walls of the closed safety container 21. Portions of the wall 27 are accessible to fingers through the openings 53 when the safety container 21 is closed.

The cover 25 is releasably secured to the base 23 by releasable locks or closures 41. In this preferred embodiment, one of the locks 41*a* is located at the front 35, while a second lock 41*b* is at one of the sides 37 and another lock 41*c* is at the other of the sides 37. Each of the locks 41 comprise at least one nub or latch 43 which extends outwardly from the wall 27 of the base 23 and a slot or catch 45 in the cover 25 which the latch 43 engages when the safety container 21 is closed. The side locks 41*b* and 41*c* include a pair of the latches 43 laterally spaced from each other. In this embodiment, the catches 45 comprise notches extending through the surface of the cover 25. The notches include lower ledges 47, which are best seen in FIG. 7.

The latches 43 are formed in the shape of prongs which have an engaging surface 49 and an upper surface 51 which slants from engaging surface 49 toward the upper edge 31 of the base 23. When the cover 25 is fully closed, the ledges 47 of the notches abut the engaging surfaces 49 of the prongs to secure the cover 25 to the base 23.

To disengage the locks 41 and thereby open the safety container 21, inward force needs to be applied to the wall 27 to move the engaging surfaces 49 off of the ledges 47. The wall 27, however, is substantially surrounded by the depending portions 39 of the cover 25. The only access to the wall 27 is through the openings 53. Therefore, to move the wall 27 inwardly, force must be applied through the openings 53. Because the openings 53 are located proximate to the latches 43 and slots 45, inward pressure through the openings 53 will disengage or release the engaging surfaces 49 from the ledges 47. The openings 53 on the sides 39 are shown as being positioned between the individual latches of the locks 41*b* and 41*c*. The individual latches of the locks 41*b* and 41*c* are sufficiently close to each other so that sufficient finger pressure at a point between them disengages or releases both of their engaging surfaces 49 from the corresponding ledges 47.

Since the wall 27 is formed of a resilient material, when inward pressure on the wall 27 ceases, the plastic memory of the wall 27 returns to its initial position. Accordingly, the locks 41 are only disengaged or opened when inward pressure is being applied to the wall 27 to displace the surfaces 49 from the ledges 47. Inward pressure thus must be applied at the three openings 53 simultaneously to disengage or open all of the locks 41 and open the safety container 21. In addition, the locks 41 are spaced apart from each other along the perimeter of the safety container 21 by sufficient distances so that they can only be activated simultaneously by using two hands.

From the foregoing, then, simultaneous operation or opening of all of the locks 41 requires not only two hands, but also a coordination of the timing of application of the inward force.

The prongs or latches 43 are preferably located near the upper edge 31 of the base 23 so that the most lateral displacement of the prongs in relation to the ledges 47 can be accomplished when lateral force is applied to the wall 27. Such a location of the prongs also improves child-resistance because the force of the plastic memory of the wall 27 at its upper edge 31 will act to effectively re-engage the latches quickly when lateral pressure is removed from it, for example, when the child thinks he or she has opened a given lock and releases it in order to attempt to open another of the locks.

A preferred way to open the safety container 21 with two hands is to hold the safety container from the bottom in one hand, placing a finger or fingers near the lock 41 in the front 35. The cover 25 is grasped by another hand from above the safety container 21 while placing a finger of this hand, such as a thumb, near one of the locks 41 on the side of the safety container 21 and placing another finger of the same hand on the lock 41 on the opposite side. When all of the locks 41 are released or opened simultaneously by the fingers positioned over them, the cover 25 is disengaged from the base 23 and the cover is pivoted to its open position.

The openings 53 communicate with, and are located below, the slots 45 at the edge of the cover 25. Such an arrangement eases opening of the safety container 21 without compromising its child-resistance features. In particular, when inward pressure is applied to the side locks 41*b* and 41*c* through their respective openings 53 by a hand placed above the safety container 21, portions of the fingers are also able to grasp edge portions 55 of the cover. In this way, once the locks 41*b* and 41*c* have been simultaneously released as required, the hand located above the safety container 21 can raise the cover 25 by grasping the edge portions 55 without needing to be repositioned from where it was when the inward pressure was applied to the side locks 41*b* and 41*c*.

The opening 53 at the front 35 extends across the width of the depending portion 39 to form a finger channel 57 with a mouth 59 opening toward the bottom portion 29 of the safety container 21. This configuration of this opening 53 allows the user's second hand to hold the base from below with a finger placed in the finger channel to apply the required inward pressure. Once the locks 41 have been simultaneously released as required, the finger in the finger channel need not be moved when the cover is lifted up from the base.

To close the safety container 21, the cover 25 is repositioned over the upper edge 31 of the base 23. The upper surfaces 51 of the prongs or latches 43 slant toward the upper edge 31, thereby forming a bevel which facilitates closing the cover 25. In particular, the depending portions 39 of the cover 25 are urged past the prongs 43 by the bevel when they are being pushed toward the base 23 of the safety container 21.

Although the safety container 21 incorporating the principles of this invention may be formed in various shapes and sizes, the preferred embodiment has the general form of a rectangular box having rounded corners 61. The front and back of the box are approximately 4½ inches long, the sides are approximately 3½ inches long, and the depth of approximately ½ inch. The latches 41, the base 23, and the cover 25 are formed integrally from a polymeric material, such as plastic.

The above dimensions allow many of the more common sized cards of blister-packaged medicines to be received within the enclosure 33. Alternative dimensions may also be used to house alternate sized cards of blister-packaged medicines. The above-listed dimensions for the safety container 21 are also within the range of dimensions suitable for making the safety container 21 pocket- or purse-sized. The rounded corners 61 facilitate inserting the safety container 21 into tight pockets or cluttered purses.

Although the safety container 21 in this embodiment has its cover 25 hingedly connected to the base 23, in an alternative embodiment, the hinged connection could be eliminated entirely and the cover 25 could be entirely separable from the base 23. In addition, another of the locks 41 could be located at the back 36 of the safety container 21 opposite the lock 41 on the front 35 of the safety container 21. This back lock would be released by fingers of the same hand releasing the lock 41*a* on the front 35.

Figure 8:
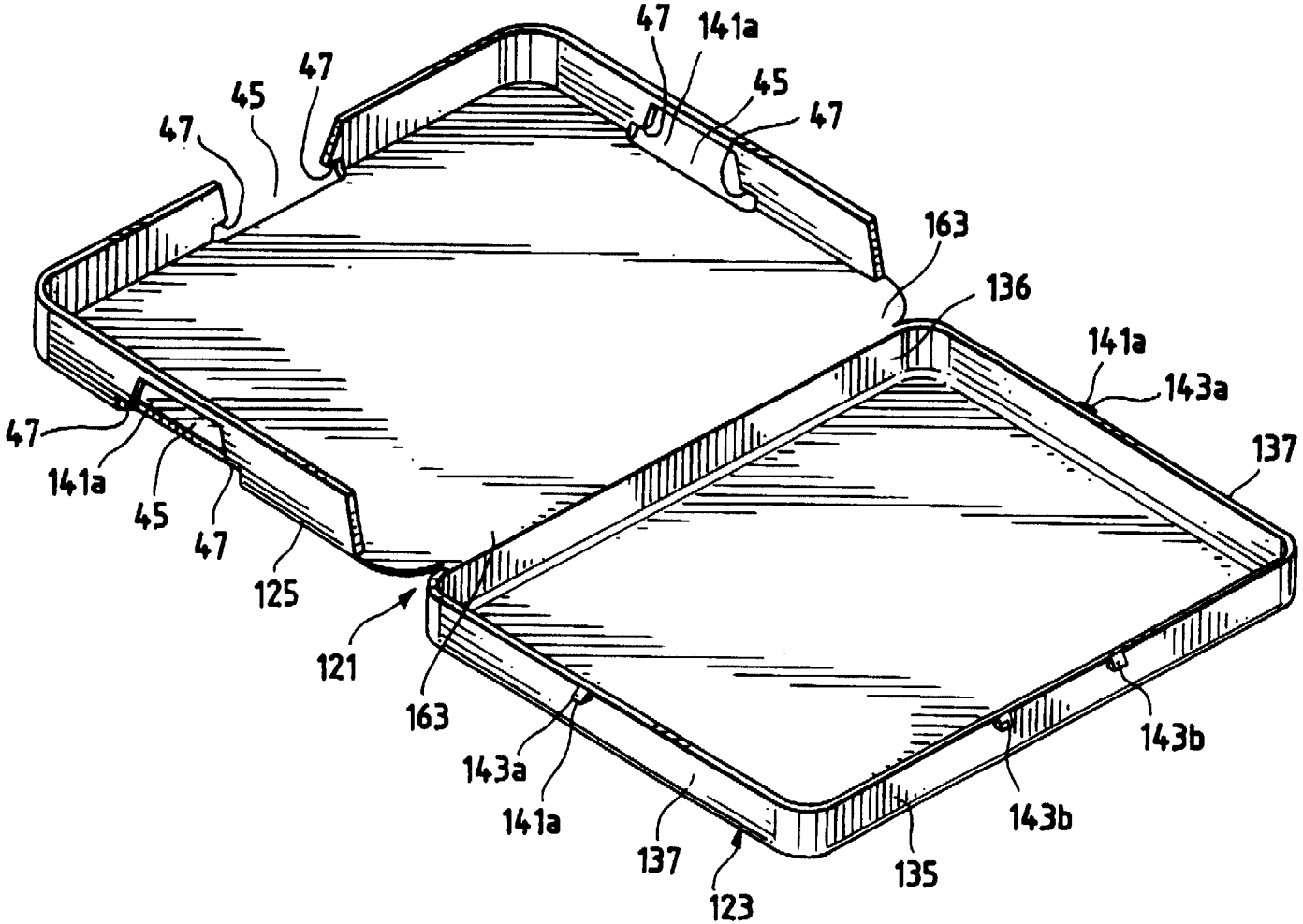
FIG. 8 is a perspective view of an alternative embodiment of the present invention.

Referring now to FIG. 8, an alternative embodiment comprises a safety container 121 with a base 123 and an associated cover 125. The cover 125 is connected to the base 123 at the base back wall 136 of the safety container 121. The hinged connection of the cover 125 to the base 123 is accomplished by means of a pair of living or piano hinges 163 which are laterally spaced from each other, rather than by using the single hinge 63 which extends substantially along the entire back of the safety container 21 (FIG. 2).

The safety container 121 uses only a single lock 141*a* on each of the opposite sides 137 of the safety container 121. The locks 141*a* comprise a single nub 143*a* positioned along the sides 137 so as to engage one of the ledges 47 of the catches 45 when the safety container 121 is in the closed position.

Figure 2:
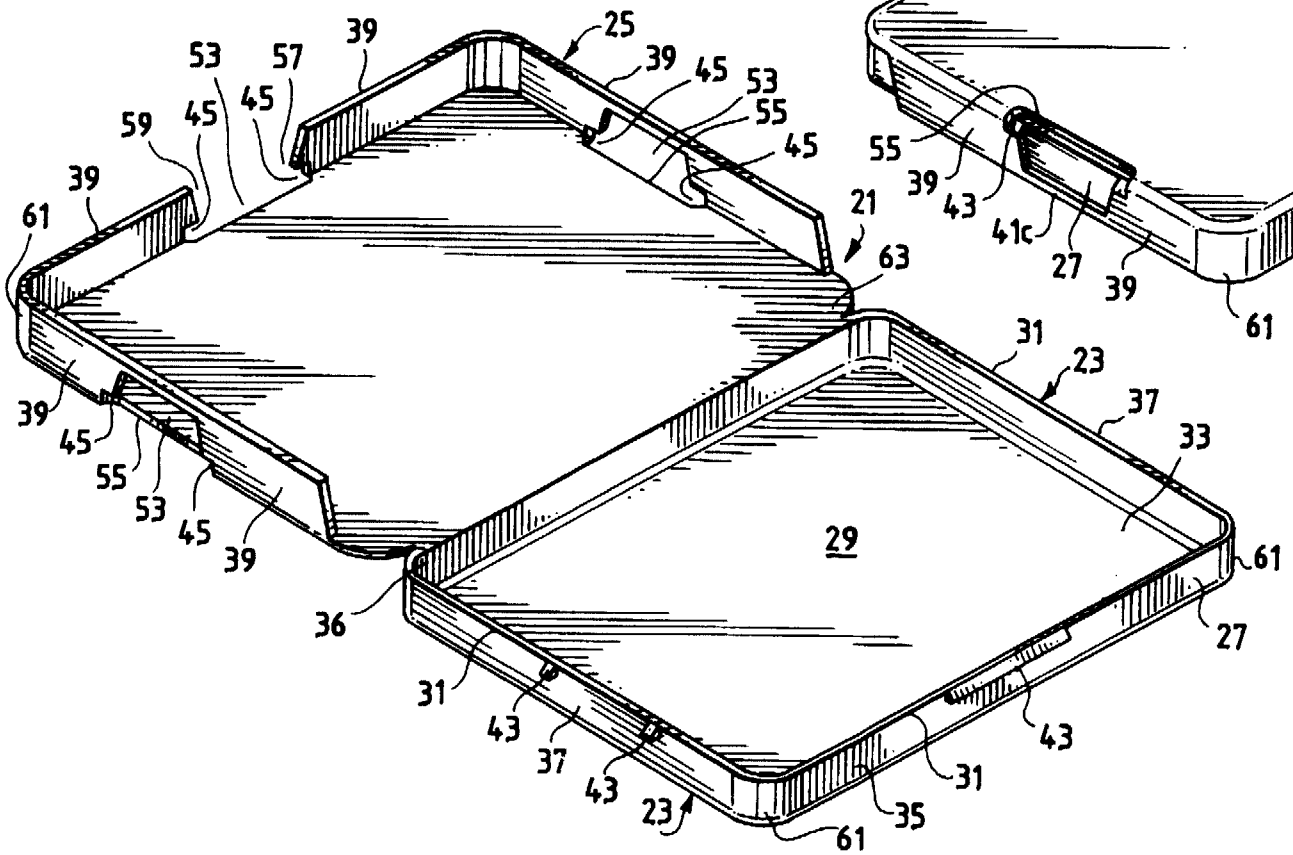
FIG. 2 is a perspective view of the safety container of FIG. 1 shown in the open position.
Figure 3:
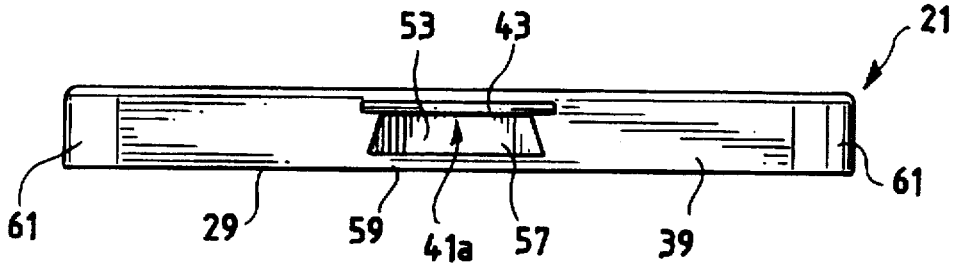
FIG. 3, 4 and 5 are front, top, and side views, respectively, of the safety container of FIG. 1.
Figure 4:
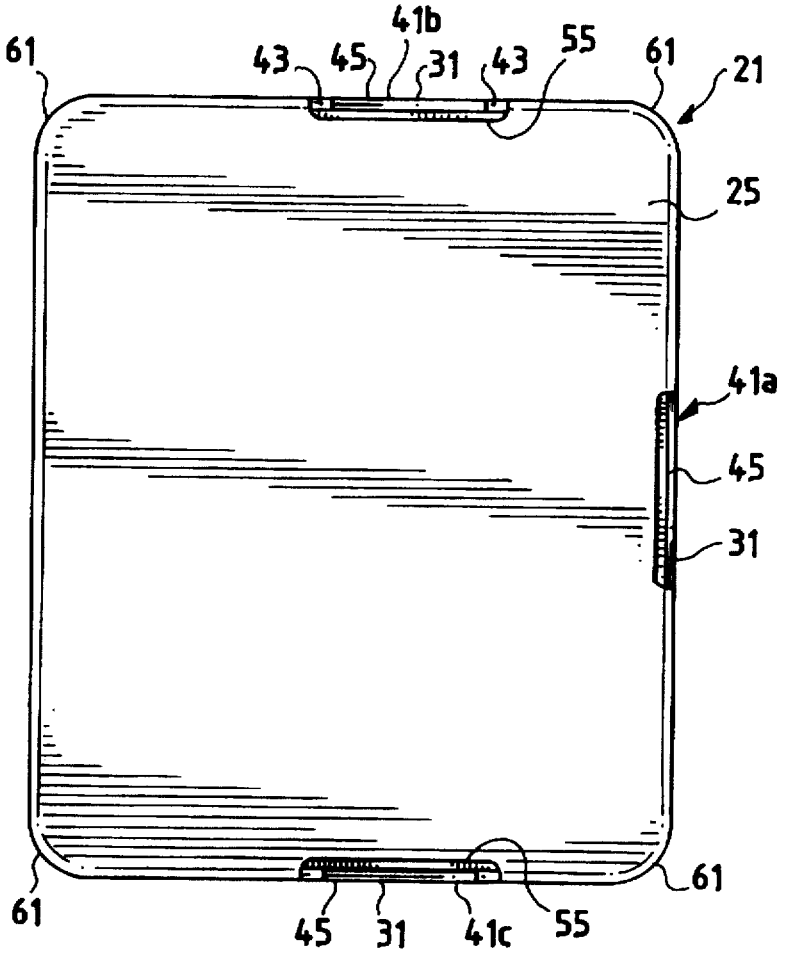
Figure 5:
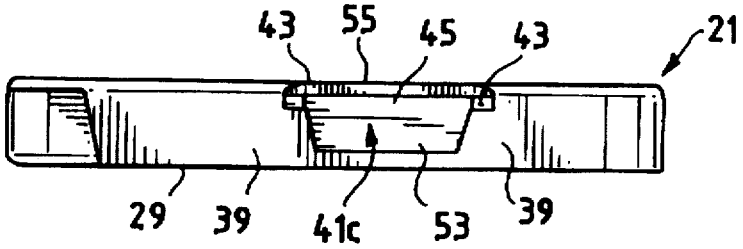

On the front 135, the safety container 121 includes a pair of nubs 143*b* rather than the single nub 43 of the previous embodiment (FIG. 2). When the safety container 121 is closed, the nubs 143*b* engage corresponding ledges 47 in the front of the cover 125.

Figure 9:
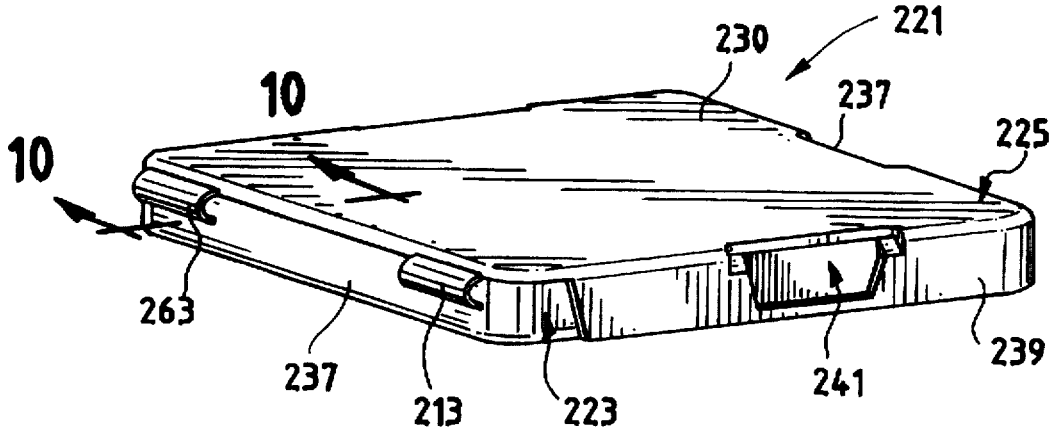
FIG. 9 is a perspective of another alternative embodiment of the safety container of the present invention.
Figure 10:
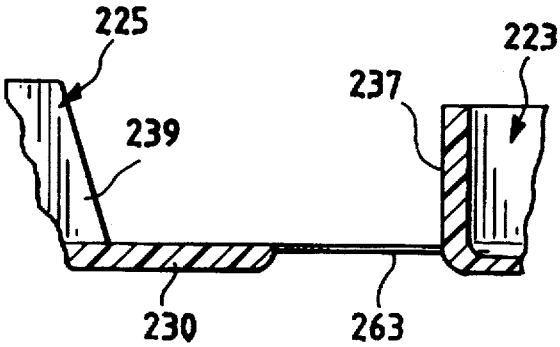
FIG. 10 is a partial sectional view taken along line 10—10 of the safety container of FIG. 9 when the container is open as shown in FIG. 2.

In another alternative embodiment shown in FIGS. 9 and 10, a safety container 221 includes a base 223 and an associated cover 225. The cover has three sides 239 (only one shown) depending from a top 230. Although the safety container 221 is generally rectangular, the cover 225 in this embodiment is hingedly attached to one of the base shorter sides 237 of the rectangular form. Also, in this embodiment the hinged connection between the cover 225 and the base 223 is accomplished by means of a pair of strap hinges 263. As shown in FIG. 10, the strap hinges 263 allow the cover 225 to be distanced from the walls of the base 223. In this way, the cover 225 may be further disassociated with the base 223 to make any contents in the safety container 221 easily accessible from any side of the safety container. The cover 225 is releasably secured to the base 223 by locks, releasable locks or closures 241 whose detail is the same as the locks previously described.

In addition to the advantages apparent from the above description of the preferred embodiment and the various alternative embodiments, the safety containers according the present invention have the advantage of being child-resistant. The necessity of activating the locks 41, 141, 241 simultaneously to access the contents of the safety container substantially inhibits access by children. If a child applies force at one of the lock points to attempt to open the box, this attempt would be thwarted by the remaining latches holding the cover secure.

If, after forcing at a first lock, the child then figures out that additional latches are still holding the cover secure, he or she may turn attention from the first lock to the other lock or locks. This also will inhibit the child's access, because even if the child succeeds in opening the second lock or succeeding locks, the original lock he forced would have reengaged as soon as the child let go of it, thereby securing the safety container. Only simultaneous activation of all of the locks will open the safety container, and a serial approach will be ineffective. As a result of this construction, many children will be denied access to potentially multiple dosages of medication.

The child-resistant aspects of the present invention are further enhanced by embodiments of the present invention which have locks which must be activated by a single hand, such as the locks on the opposite sides 37, 137, 237, but which are spaced from each other by a sufficient distance, such as 4½ inches, so that the small span of a child's hand is incapable of activating the pair of opposite locks simultaneously as required.

A further advantage of safety containers incorporating the principals of this invention is that the intended users of the safety container can gain access generally conveniently, and without frustration. The locks of the safety container do not require a great deal of strength or dexterity to be activated, because the child-resistant feature depends on simultaneous activation of the locks rather than resisting the force of a child's prying fingers. In addition, safety containers of the present invention do not require a torquing motion to be opened, which motion is at times difficult for arthritic, aging, or ailing patients. From the above, then, the present invention allows access to needed medication by those most inhibited by lack of strength or dexterity from gaining such access. In addition, even for relatively healthy individuals, access to vitamins, pills, or other medication can be accomplished with less frustration and inconvenience than under the current art.

While the present invention has been described with reference to a preferred embodiment thereof, as well as various alternative embodiments, illustrated in the accompanying drawings, various changes and modifications can be made by those skilled in the art without departing from the spirit and scope of the present invention. Therefore, the appended claims are to be construed to cover equivalent structures.

What is claimed is:

1. A container for small articles comprising:

a base having a bottom portion and at least one wall extending from the bottom portion: and a cover operatively associated with the base;

the cover includes openings therein, and wherein portions of the wall of the base are finger-accessible through the openings when the container is closed so that inward finger pressure exerted at all of the openings simultaneously moves the wall of the base inward and allows the container to be opened, the cover includes depending portions which are adjacent the wall of the base when the container is closed, and wherein the openings are located in the depending portions:

the wall of the base including at least three nubs extending outwardly from the base;

the cover having at least three catches which engage the nubs when the container is closed;

the wall of the base being resilient and by finger pressure manually displaceable in relation to the cover to disengage the nubs from the catches, the catches comprise notches extending through the surface of the cover, the notches having ledges which abut the nubs to secure the cover to the base;

the nubs and the corresponding catches being constructed to disengage the cover from the wall of the base only when all three of the catches are simultaneously disengaged from their corresponding nubs, the nubs and corresponding catches being spaced along the wall at sufficient distances from each other to require two hands to disengage the nubs from the catches, and each of said catches are disengaged by finger pressure at a single point;

the cover has a to edge and the notches are located at the top edge and wherein the openings are in communication with the notches, whereby fingers of a hand positioned above the cover can apply inward pressure to the wall while also grasping the top edge of the cover:

the opening in one of the depending portions extends the height of the depending portion to form a finger channel with a mouth opening toward the bottom of the container, so that when hand is holding the base from below the base, a finger placed in the finger channel need not be moved when the cover is separated from the base.

2. The container of claim 1, wherein the wall of the container comprises a front, back, and opposite sides, wherein the cover has a back edge hingedly connected to the back of the base, and wherein the nubs and the catches are located on the front and the opposite sides.

3. The container of claim 2 wherein the distance between the catches located on the sides exceeds 4 inches, thereby inhibiting a hand with fingers spanning less than 4 inches from simultaneously activating the locks located on the sides.

4. The container of claim 1, wherein the wall is formed of a resilient material.

5. The container of claim 1, wherein the nubs comprise prongs.

6. The container of claim 5, wherein the base has an upper edge, and wherein the prongs have an upper surface which slants toward the upper edge from the tip of the prong and an engaging surface which engages the catches when the safety container is closed.

* * * * *

UNITED STATES PATENT AND TRADEMARK OFFICE

CERTIFICATE OF CORRECTION

PATENT NO. : 5,752,615
DATED : May 19, 1998
INVENTOR(S) : Hofmann eet al

It is certified that error appears in the above-indentified patent and that said Letters Patent is hereby corrected as shown below:

Column 6, line 58, new paragraph beginning at "From the above…".

Column 7, line 10, delete ":" and insert --;--.

Column 7, line 17, delete ":" and insert --;--.

Column 7, line 21, delete ":" and insert --;--.

Column 7, line 28, delete ":" and insert --;--.

Column 8, line 5, delete "to" and insert --top--.

Column 8, line 10, delete ":" and insert --;--.

Signed and Sealed this

Thirteenth Day of April, 1999

*Attest:*

Q. TODD DICKINSON

*Attesting Officer*

*Acting Commissioner of Patents and Trademarks*